US005681436A

United States Patent [19]

Castegnier et al.

[11] Patent Number: 5,681,436

[45] Date of Patent: Oct. 28, 1997

[54] METHOD OF PREVENTING FORMATION OF UNDESIRABLE BACKGROUND ON ELECTROCOAGULATION PRINTED IMAGES

[75] Inventors: Adrien Castegnier, Outremont; Normand Lepine, Pointe-aux-Trembles, both of Canada

[73] Assignee: Elcorsy Technology Inc., Saint-Laurent, Canada

[21] Appl. No.: 608,747

[22] Filed: Feb. 29, 1996

[51] Int. Cl.[6] ..... C25D 13/00

[52] U.S. Cl. ..... 204/486; 204/483; 204/508; 101/DIG. 29

[58] Field of Search ..... 204/486, 483, 204/508; 101/DIG. 29

[56] References Cited

U.S. PATENT DOCUMENTS

| | | | |
|---|---|---|---|
| 3,892,645 | 7/1975 | Castegnier | 204/180 R |
| 4,555,320 | 11/1985 | Castegnier | 204/180.9 |
| 4,661,222 | 4/1987 | Castegnier | 204/180.9 |
| 4,895,629 | 1/1990 | Castegnier | 204/180.9 |
| 5,449,392 | 9/1995 | Castegnier et al. | 118/46 |
| 5,538,601 | 7/1996 | Castegnier | 204/486 |

*Primary Examiner*—Kathryn L. Gorgos
*Assistant Examiner*—Kishor Mayekar
*Attorney, Agent, or Firm*—Swabey Ogilvy Renault; Robert Carrier

[57] ABSTRACT

An improved electrocoagulation printing method comprising the steps of (a) providing a positive electrode formed of an electrolytically inert metal and having a continuous passivated surface moving at substantially constant speed along a predetermined path, the passivated surface defining a positive electrode active surface; (b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and (c) bringing a substrate into contact with the dots of colored, coagulated colloid to cause transfer of the colored, coagulated colloid from the positive electrode active surface onto the substrate and thereby imprint the substrate with the image. The improvement resides in applying between steps (b) and (c) on the positive electrode active surface a liquid olefinic substance to dislodge any remaining ink from the surface without altering the dots of colored, coagulated colloid, and removing the dislodged ink in admixture with the olefinic substance from the positive electrode active surface, thereby preventing formation of undesirable background on the printed image in step (c).

30 Claims, No Drawings

METHOD OF PREVENTING FORMATION OF UNDESIRABLE BACKGROUND ON ELECTROCOAGULATION PRINTED IMAGES

BACKGROUND OF THE INVENTION

The present invention pertains to improvements in the field of electrocoagulation printing. More particularly, the invention relates to a method of preventing formation of undesirable background on electrocoagulation printed images.

In U.S. Pat. No. 4,895,629 of Jan. 23, 1990, Applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate.

When a polychromic image is desired, the negative and positive electrodes, the positive electrode coating device, ink injector and rubber squeegee are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

Applicant has observed that the rubber squeegee which used for removing non-coagulated colloid from the surface of the positive electrode leaves on the surface a film of ink which is transferred with the colored, coagulated colloid onto the substrate during contact with same. Thus, when black, cyan, magenta and yellow coloring agents are used to provide a polychromic image, the residual films containing these coloring agents upon being transferred onto the substrate in superimposed relation create on the printed image an undesirable colored background. Moreover, the electrolyte contained in the residual film crystallizes upon evaporation of the dispersing medium to form on the surface of the positive electrode a deposit which adversely affects the transfer of the colored, coagulated colloid and the adherence thereof to the substrate, as well as color saturation.

SUMMARY OF THE INVENTION

It is therefore an object of the present invention to overcome the above drawbacks and to provide a method of preventing formation of undesirable background on electrocoagulation printed images.

It is another object of the invention to improve transfer of the colored, coagulated colloid onto a substrate.

In accordance with the present invention, there is provided an improved electrocoagulation printing method comprising the steps of:

a) providing a positive electrode formed of an electrolytically inert metal and having a continuous passivated surface moving at substantially constant speed along a predetermined path, the passivated surface defining a positive electrode active surface;

b) forming on the positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and c) bringing a substrate into contact with the dots of colored, coagulated colloid to cause transfer of the colored, coagulated colloid from the positive electrode active surface onto the substrate and thereby imprint the substrate with the image;

the improvement which comprises:

applying between steps (b) and (c) on the positive electrode active surface a liquid olefinic substance to dislodge any remaining ink from the surface without altering the dots of colored, coagulated colloid; and removing the dislodged ink in admixture with the olefinic substance from the positive electrode active surface, thereby preventing formation of undesirable background on the printed image in step (c).

It has surprisingly been found, according to the invention, that by applying a liquid olefinic substance on the positive electrode active surface between steps (b) and (c), such a substance dislodges any remaining ink from the surface of the electrode without altering the dots of colored, coagulated colloid. Thus, by removing the dislodged ink in admixture with the olefinic substance from the positive electrode active surface while leaving thereon the unaltered dots of colored, coagulated colloid, not only is the formation of undesirable background on the printed image prevented, but also the transfer of the colored, coagulated colloid and the adherence thereof to the substrate as well as the color saturation are significantly improved due to the removal of the electrolyte with the ink.

DESCRIPTION OF PREFERRED EMBODIMENTS

Where a polychromic image is desired, steps (b) and (c) of the above electrocoagulation printing method are repeated several times to define a corresponding number of printing stages arranged at predetermined locations along the aforesaid path and each using a coloring agent of different color, and to thereby produce several differently colored images of coagulated colloid which are transferred at the respective transfer positions onto the substrate in superimposed relation to provide a polychromic image. According to the invention, the aforesaid olefinic substance is applied on the positive electrode active surface between steps (b) and (c) of each printing stage to dislodge any remaining link from the surface and the dislodged ink in admixture with the olefinic substance is removed from the positive electrode active surface.

The positive electrode used can be in the form of a moving endless belt as described in Applicant's U.S. Pat. No. 4,661,222, or in the form of a revolving cylinder as described in the aforementioned U.S. Pat. No. 4,895,629, the teachings of which are incorporated herein by reference. In later case, the printing stages are arranged around the positive cylindrical electrode.

When use is made of a positive electrode of cylindrical configuration rotating at substantially constant speed about its central longitudinal axis, step (b) of the above electrocoagulation printing method is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap;

ii) coating the positive electrode active surface with a further olefinic substance and a metal oxide to form on the surface micro-droplets of olefinic substance containing the metal oxide;

iii) filling the electrode gap with the aforesaid electrocoagulation printing ink;

iv) electrically energizing selected ones of the negative electrodes to cause point-by-point selective coagulation and adherence of the colloid onto the olefin and metal oxide-coated positive electrode active surface opposite the electrode active surfaces of the energized negative electrodes while the positive electrode is rotating, thereby forming the dots of colored, coagulated colloid; and v) removing any remaining non-coagulated colloid from the positive electrode active surface.

As explained in U.S. Pat. No. 4,895,629, spacing of the negative electrodes from one another by a distance which is equal to or greater than the electrode gap prevents the negative electrodes from undergoing edge corrosion. On the other hand, coating of the positive electrode with an olefinic substance and a metal oxide prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes.

Examples of suitable electrolytically inert metals from which the positive and negative electrodes can be made are stainless steel, platinum, chromium, nickel and aluminum. The positive electrode is preferably made of stainless steel or aluminum so that upon electrical energization of the negative electrodes, dissolution of the passive oxide film on such an electrode generates trivalent ions which then initiate coagulation of the colloid.

The gap which is defined between the positive and negative electrodes can range from about 50 μm to about 100 μm, the smaller the electrode gap the sharper are the dots of coagulated colloid produced. Where the electrode gap is of the order of 50 μm, the negative electrodes are the preferably spaced from one another by a distance of about 75 μm.

Examples of suitable olefinic substances which may be used to coat the surface of the positive electrode in step (b)(ii) include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. The olefinic substance is advantageously applied onto the positive electrode active surface in the form of an oily dispersion containing the metal oxide as dispersed phase. Examples of suitable metal oxides include aluminum oxide, ceric oxide, chromium oxide, cupric oxide, magnesium oxide, manganese oxide, titanium dioxide and zinc oxide; chromium oxide is the preferred metal oxide. Depending on the type of metal oxide used, the amount of metal oxide may range from about 20 to about 60% by weight, based on the total weight of the dispersion. Preferably, the olefinic substance and the metal oxide are present in the dispersion in substantially equal amounts. A particularly preferred dispersion contains about 50 wt. % of oleic acid or linoleic acid and about 50 wt. % of chromium oxide.

The oily dispersion containing the olefinic substance and the metal oxide is advantageously applied onto the positive electrode active surface by providing a distribution roller extending parallel to the positive cylindrical electrode and having a peripheral coating comprising an oxide ceramic material, applying the oily dispersion onto the ceramic coating to form on a surface thereof a film of the oily dispersion uniformly covering the surface of the ceramic coating, the film of oily dispersion breaking down into micro-droplets containing the olefinic substance in admixture with the metal oxide and having substantially uniform size and distribution, and transferring the micro-droplets from the ceramic coating onto the positive electrode active surface. As explained in Applicant's U.S. Pat. No. 5,449,392 of Sep. 12, 1995, the teaching of which is incorporated herein by reference, the use of a distribution roller having a ceramic coating comprising an oxide ceramic material enables one to form on a surface of such a coating a film of the oily dispersion which uniformly covers the surface of the ceramic coating and thereafter breaks down into micro-droplets containing the olefinic substance in admixture with the metal oxide and having substantially uniform size and distribution. The micro-droplets formed on the surface of the ceramic coating and transferred onto the positive electrode active surface generally have a size ranging from about 1 to about 5 μm.

A particularly preferred oxide ceramic material forming the aforesaid ceramic coating comprises a fused mixture alumina and titania. Such a mixture may comprise about 60 to about 90 weight. % of alumina and about 10 to about 40 weight % of titania.

According to a preferred embodiment of the invention, the oily dispersion is applied onto the ceramic coating by disposing an applicator roller parallel to the distribution roller and in pressure contact engagement therewith to form a first nip, and rotating the applicator roller and the distribution roller in register while feeding the oily dispersion into the first nip, whereby the oily dispersion upon passing through the first nip forms a film uniformly covering the surface of the ceramic coating. The micro-droplets are advantageously transferred from the distribution roller to the positive electrode by disposing a transfer roller parallel to the distribution roller and in contact engagement therewith to form a second nip, positioning the transfer roller in pressure contact engagement with the positive electrode to form a third nip, and rotating the transfer roller and the positive electrode in register for transferring the micro-droplets from the distribution roller to the transfer roller at the second nip and thereafter transferring the micro-droplets from the transfer roller to the positive electrode at the third nip. Such an arrangement of rollers is described in the aforementioned U.S. Pat. No. 5,449,392.

Preferably, the applicator roller and the transfer roller are each provided with a peripheral covering of a resilient material which is resistant to attack by the olefinic substance, such as a synthetic rubber material. For example, use can be made of a polyurethane having a Shore A hardness of about 50 to about 70 in the case of the applicator roller, or a Shore A hardness of about 60 to about 80 in the case of the transfer roller.

In some instances, depending on the type of olefinic substance used, Applicant has noted that the film of oily dispersion only partially breaks down on the surface of the ceramic coating into the desired micro-droplets. Thus, in order to ensure that the film of oily dispersion substantially completely breaks on the ceramic coating into micro-droplets of olefinic substance containing the metal oxide and having substantially uniform size and distribution, step (b)(ii) of the electrocoagulation printing method of the invention is preferably carried out by providing first and second distribution rollers extending parallel to the positive cylindrical electrode and each having a peripheral coating comprising an oxide ceramic material, applying the oily dispersion onto the ceramic coating of the first distribution roller to form on a surface thereof a film of the oily dispersion uniformly covering the surface of the ceramic coating, the film of oily dispersion at least partially breaking down into micro-droplets containing the olefinic substance in admixture with the metal oxide and having substantially uniform size and distribution, transferring the at least partially broken film from the first distribution roller to the second distribution roller so as to cause the film to substantially completely break on the ceramic coating of the second distribution roller into the desired micro-droplets having substantially uniform size and distribution, and transferring the micro-droplets from the ceramic coating of the second distribution roller onto the positive electrode active surface. Preferably, the ceramic coatings of the first distribution roller and the second distribution roller comprise the same oxide ceramic material. Such an arrangement of rollers is described in U.S. Pat. No. 5,538,601 of Jul. 23, 1996, the teaching of which is incorporated herein by reference.

According to a preferred embodiment, the oily dispersion is applied onto the ceramic coating of the first distribution roller by disposing an applicator roller parallel to the first distribution roller and in pressure contact engagement therewith to form a first nip, and rotating the applicator roller and the first distribution roller in register while feeding the oily dispersion into the first nip, whereby the oily dispersion upon passing through the first nip forms a film uniformly covering the surface of the ceramic coating.

According to another preferred embodiment, the at least partially broken film of oily dispersion is transferred from the first distribution roller to the second distribution roller and the micro-droplets are transferred from the second distribution roller to the positive electrode by disposing a first transfer roller between the first distribution roller and the second distribution roller in parallel relation thereto, positioning the first transfer roller in pressure contact engagement with the first distribution roller to form a second nip and in contact engagement with the second distribution roller to form a third nip, rotating the first distribution roller and the first transfer roller in register for transferring the at least partially broken film from the first distribution roller to the first transfer roller at the second nip, disposing a second transfer roller parallel to the second distribution roller and in pressure contact engagement therewith to form a fourth nip, positioning the second transfer roller in pressure contact engagement with the positive electrode to form a fifth nip, and rotating the second distribution roller, the second transfer roller and the positive electrode in register for transferring the at least partially broken film from the first transfer roller to the second distribution roller at the third nip, then transferring the micro-droplets from the second distribution roller to the second transfer roller at the fourth nip and thereafter transferring the micro-droplets from the second transfer roller to the positive electrode at the fifth nip. Such an arrangement of rollers is also described in the aforementioned U.S. Pat. No. 5,538,601. Preferably, the applicator roller, first transfer roller and second transfer roller are each provided with a peripheral covering of a resilient material which is resistant to attack by the olefinic substance.

Where the positive cylindrical electrode extends vertically, step (b)(iii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a molecular weight comprised between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a molecular weight of about 250,000 and sold by Cyanamid Inc. under the trade mark ACCOSTRENGTH 86. The colloid is preferably used in an amount of about 6.5 to about 12% by weight, and more preferably in an amount of about 7% by weight, based on the total weight of the colloidal dispersion. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. The electrolyte is preferably used in an amount of about 6.5 to about 9% by weight, based on the total weight of the dispersion. The coloring agent can be a dye or a pigment. Examples of suitable dyes which may be used to color the colloid are the water soluble dyes available from HOECHST such a Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the non-ionic dispersing agent sold by ICI Canada Inc. under the trade mark SOLSPERSE 27000. The pigment is preferably used in an amount of about 6.5 to about 12% by weight, and the dispersing agent in an amount of about 0.4 to about 6% by weight, based on the total weight of the ink.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The liquid olefinic substance which is applied on the positive electrode active surface between steps (b) and (c) is of the same type as the olefinic substance used in step (b)(ii). The olefinic substance used between steps (b) and (c) is advantageously the same as that used in step (b)(ii). Oleic acid is preferably used.

The liquid olefinic substance is advantageously applied between steps (b) and (c) on the positive electrode active surface in the same manner as the ink in step (b)(iii), by continuously discharging the olefinic substance onto the positive electrode active surface from another fluid discharge means disposed at a predetermined height relative to the positive electrode and allowing the olefinic substance to flow downwardly along the positive electrode active surface. The dislodged ink in admixture with the olefinic substance is preferably removed from the positive electrode active surface by scraping the surface with a soft rubber squeegee.

According to a preferred embodiment, the mixture of dislodged ink and olefinic substance removed from the positive electrode active surface is collected, the olefinic substance is separated from the collected mixture and the separated olefinic substance is recirculated back to the aforesaid fluid discharge means. Preferably, the olefinic substance is separated from the mixture by admixing water with the mixture to form an aqueous phase containing the dislodged ink and an oily phase containing the olefinic substance, separating the oily phase from the aqueous phase, for example, by decantation or centrifugation, filtering the separated oily phase to remove therefrom suspended solids and recovering the filtered oily phase for recirculation back to the fluid discharge means. Diatomaceous earth can be used for filtering the oily phase.

We claim:

1. In an electrocoagulation printing method comprising the steps of:

a) providing a positive electrode formed of an electrolytically inert metal and having a continuous passivated surface moving at constant speed along a selected path, said passivated surface defining a positive electrode active surface;

b) forming on said positive electrode active surface a plurality of dots of colored, coagulated colloid representative of a selected image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and c) bringing a substrate into contact with the dots of colored, coagulated colloid to cause transfer of the dots of colored, coagulated colloid from the positive electrode active surface onto said substrate and to imprint said substrate with said image;

the improvement which comprises applying between steps (b) and (c) on said positive electrode active surface a liquid olefinic substance to dislodge any remaining ink from said surface without altering said dots of colored, coagulated colloid; and removing the dislodged ink in admixture with said olefinic substance from said positive electrode active surface, to prevent formation of unnecessary background on the subsequently printed image in step (c).

2. A method as claimed in claim 1, wherein said liquid olefinic substance is selected from the group consisting of unsaturated fatty acids and unsaturated vegetable oils.

3. A method as claimed in claim 2, wherein said liquid olefinic substance is an unsaturated fatty acid selected from the group consisting of arachidonic acid, linoleic acid, linolenic acid, oleic acid and palmitoleic acid.

4. A method as claimed in claim 3, wherein said liquid olefinic substance is oleic acid.

5. A method as claimed in claim 2, wherein said liquid olefinic substance is an unsaturated vegetable oil selected from the group consisting of corn oil, linseed oil, olive oil, peanut oil, soybean oil and sunflower oil.

6. A method as claimed in claim 1, wherein steps (b) and (c) are repeated several times to define a corresponding number of printing stages arranged at selected locations along said path and each using a coloring agent of different color, and to produce several differently colored images of coagulated colloid which are transferred at respective transfer positions onto said substrate in superimposed relation to provide a polychromic image, and wherein said liquid olefinic substance is applied on the positive electrode active surface between steps (b) and (c) of each printing stage.

7. A method as claimed in claim 6, wherein said positive electrode is a cylindrical electrode having a central longitudinal axis and rotating at constant speed about said longitudinal axis, and wherein said printing stages are arranged around said positive cylindrical electrode.

8. A method as claimed in claim 7, wherein step (b) is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant selected gap, said negative electrodes being spaced from one another by a distance at least equal to said electrode gap;

ii) coating the positive electrode active surface with a further liquid olefinic substance and a metal oxide to form on said surface micro-droplets of olefinic substance containing the metal oxide;

iii) filling said electrode gap with said electrocoagulation printing ink;

iv) electrically energizing selected ones of said negative electrodes to cause point-by-point selective coagulation and adherence of the colloid onto the olefin and metal oxide-coated positive electrode active surface opposite the electrode active surfaces of said energized negative electrodes while said positive electrode is rotating, to form said dots of colored, coagulated colloid; and v) removing any remaining non-coagulated colloid from said positive electrode active surface.

9. A method as claimed in claim 8, wherein step (b) (ii) is carried out by providing a distribution roller extending parallel to said positive electrode and having a peripheral ceramic coating comprising an oxide ceramic material, applying said further liquid olefinic substance in the form of an oily dispersion containing said metal oxide as dispersed phase onto the ceramic coating to form on a surface thereof a film of said oily dispersion uniformly covering the surface of said ceramic coating, said film of oily dispersion breaking down into micro-droplets containing said further liquid olefinic substance in admixture with said metal oxide and having uniform size and distribution, and transferring said micro-droplets from said ceramic coating onto said positive electrode active surface.

10. A method as claimed in claim 9, wherein said oxide ceramic material comprises a fused mixture of alumina and titania.

11. A method as claimed in claim 9, wherein said oily dispersion is applied onto said ceramic coating by disposing an applicator roller parallel to said distribution roller and in pressure contact engagement therewith to form a first nip, and rotating said applicator roller and said distribution roller in register while feeding said oily dispersion into said first nip, such that said oily dispersion upon passing through said first nip forms said film uniformly covering the surface of said ceramic coating.

12. A method as claimed in claim 11, wherein said micro-droplets are transferred from said distribution roller to said positive electrode by disposing a transfer roller parallel to said distribution roller and in contact engagement therewith to form a second nip, positioning said transfer roller in pressure contact engagement with said positive electrode to form a third nip, and rotating said transfer roller and said positive electrode in register for transferring said micro-droplets from said distribution roller to said transfer roller at said second nip and thereafter transferring said micro-droplets from said transfer roller to said positive electrode at said third nip.

13. A method as claimed in claim 12, wherein said applicator roller and said transfer roller are each provided with a peripheral covering of a resilient material which is resistant to attack by said further olefinic substance.

14. A method as claimed in claim 8, wherein step (b) (ii) is carried out by providing first and second distribution rollers extending parallel to said positive electrode and each having a peripheral ceramic coating comprising an oxide ceramic material, applying said further liquid olefinic substance in the form of an oily dispersion containing said metal oxide as dispersed phase onto the ceramic coating of said first distribution roller to form on a surface thereof a film of said oily dispersion uniformly covering the surface of said ceramic coating, said film of oily dispersion at least partially breaking down into micro-droplets containing said further liquid olefinic substance in admixture with said metal oxide and having uniform size and distribution, transferring the at least partially broken film from said first distribution roller to said second distribution roller to cause said film to completely break on the ceramic coating of said second distribution roller into said micro-droplets having uniform size and distribution, and transferring said micro-droplets from the ceramic coating of said second distribution roller onto said positive electrode active surface.

15. A method as claimed in claim 14, wherein the ceramic coatings of said first distribution roller and said second distribution roller comprise the same oxide ceramic material, and wherein said oxide ceramic material comprises a fused mixture of alumina and titania.

16. A method as claimed in claim 14, wherein said oily dispersion is applied onto the ceramic coating of said first distribution roller by disposing an applicator roller parallel to said first distribution roller and in pressure contact engagement therewith to form a first nip, and rotating said applicator roller and said first distribution roller in register while feeding said oily dispersion into said first nip, such that said oily dispersion upon passing through said first nip forms said film uniformly covering the surface of said ceramic coating.

17. A method as claimed in claim 16, wherein said at least partially broken film of oily dispersion is transferred from said first distribution roller to said second distribution roller and said micro-droplets are transferred from said second distribution roller to said positive electrode by disposing a first transfer roller between said first distribution roller and said second distribution roller in parallel relation thereto, positioning said first transfer roller in pressure contact engagement with said first distribution roller to form a second nip and in contact engagement with said second distribution roller to form a third nip, rotating said first distribution roller and said first transfer roller in register for transferring said at least partially broken film from said first distribution roller to said first transfer roller at said second nip, disposing a second transfer roller parallel to said second distribution roller and in pressure contact engagement therewith to form a fourth nip, positioning said second transfer roller in pressure contact engagement with said positive electrode to form a fifth nip, and rotating said second distribution roller, said second transfer roller and said positive electrode in register for transferring said at least partially broken film from said first transfer roller to said second distribution roller at said third nip, then transferring said micro-droplets from said second distribution roller to said second transfer roller at said fourth nip and thereafter transferring said micro-droplets from said second transfer roller to said positive electrode at said fifth nip.

18. A method as claimed in claim 17, wherein said applicator roller, said first transfer roller and said second transfer roller are each provided with a peripheral covering of a resilient material which is resistant to attack by said further liquid olefinic substance.

19. A method as claimed in claim 8, wherein said further liquid olefinic substance is selected from the group consisting of unsaturated fatty acids and unsaturated vegetable oils.

20. A method as claimed in claim 19, wherein said further liquid olefinic substance is an unsaturated fatty acid selected from the group consisting of arachidonic acid, linoleic acid, linolenic acid, oleic acid and palmitoleic acid.

21. A method as claimed in claim 20, wherein said further liquid olefinic substance is oleic acid.

22. A method as claimed in claim 19, wherein said further liquid olefinic substance is an unsaturated vegetable oil selected from the group consisting of corn oil, linseed oil, olive oil, peanut oil, soybean oil and sunflower oil.

23. A method as claimed in claim 8, wherein said liquid olefinic substance and said further liquid olefinic substance are the same.

24. A method as claimed in claim 8, wherein said liquid olefinic substance and said further liquid olefinic substance are different.

25. A method as claimed in claim 7, wherein said positive electrode extends vertically and wherein said liquid olefinic substance is applied on the positive electrode active surface by continuously discharging same onto said positive electrode active surface from a fluid discharge means disposed at a selected height relative to said positive electrode and allowing said liquid olefinic substance to flow downwardly along said positive electrode active surface.

26. A method as claimed in claim 25, wherein the mixture of dislodged ink and liquid olefinic substance removed from said positive electrode active surface is collected, the liquid olefinic substance is separated from the collected mixture and the separated olefinic substance is recirculated back to said fluid discharge means.

27. A method as claimed in claim 26, wherein said liquid olefinic substance is separated from said mixture by admixing water with said mixture to form an aqueous phase containing said dislodged ink and an oily phase containing said olefinic substance, separating said oily phase from said aqueous phase, filtering the separated oily phase to remove therefrom suspended solids and recovering the filtered oily phase for recirculation back to said fluid discharge means.

28. A method as claimed in claim 27, wherein said oily phase is separated from said aqueous phase by decantation.

29. A method as claimed in claim 27, wherein said oily phase is separated from said aqueous phase by centrifugation.

30. A method as claimed in claim 27, wherein the separated oily phase is filtered through diatomaceous earth.

* * * * *